US005474432A

United States Patent [19]

Hulley et al.

[11] Patent Number: 5,474,432

[45] Date of Patent: Dec. 12, 1995

[54] PROGRESSIVE CAVITY PUMP OR MOTORS

[75] Inventors: Stephen P. Hulley, Reddish Vale; Roger L. Naylor, Mossley Lancs.; Gareth D. Thomas, Hadfield, all of United Kingdom

[73] Assignee: Mono Pumps Limited, Manchester, United Kingdom

[21] Appl. No.: 195,367

[22] Filed: Feb. 14, 1994

[30] Foreign Application Priority Data

Feb. 22, 1993 [GB] United Kingdom ..... 9303507

[51] Int. Cl.[6] ..... F04C 2/107

[52] U.S. Cl. ..... 418/48

[58] Field of Search ..... 418/48, 108, 153

[56] References Cited

U.S. PATENT DOCUMENTS

| | | | |
|---|---|---|---|
| 3,011,445 | 12/1961 | Bourke | 418/48 X |
| 3,857,654 | 12/1974 | Streicher . | |
| 4,029,443 | 6/1977 | Burnside | 418/48 |
| 4,313,717 | 2/1982 | Kopecky | 418/48 |

FOREIGN PATENT DOCUMENTS

| | | | |
|---|---|---|---|
| 0083829 | 7/1983 | European Pat. Off. . | |
| 0380050 | 8/1990 | European Pat. Off. . | |
| 2930068 | 3/1981 | Germany | 418/48 |
| 3312197 | 10/1984 | Germany | 418/48 |
| 3322095 | 12/1984 | Germany | 418/48 |
| 1150339 | 4/1969 | United Kingdom . | |
| 1542786 | 3/1979 | United Kingdom . | |

*Primary Examiner*—Richard E. Gluck
*Attorney, Agent, or Firm*—Harness, Dickey & Pierce

[57] ABSTRACT

A stator assembly for a progressive pump or motor, comprising a resilient material stator (10) having a helical bore (12) therethrough, the cylindrical outer surface (14) of the stator having a plurality of axially extending circumferentially spaced outward projections (16). A rigid generally tubular member (22) has cooperating recesses (24) and may be formed of a unitary tube or of a plurality of shell elements with a cooperating clamp arrangement (32–36). The side faces (18,20) of the projections are flat and either parallel to one another or are inclined towards one another in the radially outward direction.

10 Claims, 3 Drawing Sheets

PROGRESSIVE CAVITY PUMP OR MOTORS

The present invention relates to progressive cavity pump or motor apparatus and to a stator assembly therefore.

One form of such apparatus comprises a stator having a bore with a female helical gear formation thereon of n starts, a rotor rotatable in said bore and having a cooperating male helical gear formation having n±1 starts, and depending on whether or not the apparatus is a pump or a motor, means are provided to rotate the rotor or to be rotated by the rotor relative to the stator. Traditionally the stator is formed of a resilient material, such as rubber or the like.

Various designs of stator been proposed. In one the stator is supported only at one axial end by means of a radially outwardly extending flange. In a second design the resilient material stator is moulded into a sleeve referred to as a barrel and this requires a very considerable amount of pretreatment of the barrel before it is introduced into the mould. Basically, the cost of such a moulded-in stator is in the order of five times of that of a stator which is not moulded in. However, one of the advantages of a moulded-in stator is that it prevents or very significantly reduces any tendency for the stator to undergo torsionally deformation due to the operation of the rotor. Any torsionally deformation can significantly reduce the efficiency of the pump or motor.

Various proposals have been made wherein the stator is radially compressed by one means or another to ensure a good sealing fit onto the rotor.

EP-A-0083829, for example, discloses an arrangement in which the stator is provided with three radially outwardly extending axial ribs and a housing is formed of three essentially identical segments which are generally arcuate and each has a radially outwardly extending stub flange along one edge which cooperatingly engages with a cap flange on the opposite edge of an adjacent identical segment. This arrangement provides a truncated V-shaped groove within which the radially outwardly extending rib is engaged, the rib having a radial extent greater than the thickness of the flange. One or more screw operated band clamps surround the assembly to squeeze the housing elements against the outer surface of the stator.

While this arrangement is generally satisfactory, it does produce the disadvantage that at the location of the ribs, the inner surface of the stator, that is the female helical gear formation therein, bulges inwardly which increases the local interference and can produce leak paths through the length of the progressive cavity pump.

U.S. Pat. No. 3,857,654 shows a somewhat more complex arrangement in which a large number of overlapping housing elements each of stepped configuration, are urged inwardly by one or more rollers, and the rollers themselves are urged inwardly by a clamp arrangement. This is a very complex design and does not really address the problem of torsional twisting in a really satisfactory manner. Similar problems arise with a somewhat simpler construction of GB-A-799996.

It is now proposed, according to the present invention, to provide a stator assembly for a progressive cavity pump or motor apparatus comprising a stator having a bore with a female helical gear formation thereon of n starts, a rotor rotatable in said bore and having a cooperating male helical gear formation having n±1 starts, means to rotate or be rotated by said rotor relative to said stator, said stator assembly comprising a stator formed of a resilient material and having a substantially cylindrical outer surface including a plurality of axially extending, circumferentially spaced radially outwardly extending projections and an outer generally tubular rigid member completely surrounding said stator and having a plurality of internal, axially extending, circumferentially spaced recesses, shaped to cooperate with and engage on each circumferential side of said projections to prevent relative rotation therebetween about the axis of the stator, the projections each being formed with a generally cylindrical outer face and each being provided with substantially flat side faces which are inclined towards one another in the radially outward direction or are substantially parallel to one another, the circumferential extent of the projections being of the same order of magnitude as the circumferential extent of the spaces therebetween.

With a structure because the generally tubular rigid member completely surrounds the stator there is little problem of high spots being produced on the female helical gear formation. Furthermore, because the generally tubular rigid member has a plurality of internal, axially extending, circumferentially spaced recesses which are so shaped to cooperate with and to engage on each circumferential side of the projections, while still having the projections wholly within the tubular generally rigid member, relative rotation of the stator about its axis can be prevented.

For larger pumps and motors the number of projections and cooperating recesses will normally be three or more, three being the preferred number. For very small pumps and motors it has been found preferable to have only two projections and two cooperating recesses.

The generally tubular rigid member completely surrounding said stator may be of a unitary structure having circumferentially spaced internal grooves forming said axially extending recesses and the stator may fit snugly therewithin. The internal grooves may be formed by casting, by broaching or preferably by extrusion. Such a structure has most of the advantages of a moulded-in stator but is very significantly less expensive to produce because the treatment of the barrel of the moulded-in stator does not have to be effected prior to the moulding process. It is believed that such a structure could have results comparable with those of a moulded-in stator but at no more than approximately a quarter of the price.

It will be appreciated that the generally rigid tubular member can itself be reused, which is a saving in material, and all that is necessary to replace is a worn stator itself. The moulding of such a stator with the circumferentially spaced radially outwardly projecting elements is relatively easy.

The invention also contemplates the outer generally tubular rigid member completely surrounding the stator comprising a plurality of circumferentially discrete part cylindrical shell members each having first and second axially extending side edges and at least one tightenable clamp surrounding said shell members enabling said shell members to be radially tightened against said stator. This has the advantages enumerated above and with the additional advantage that the stator can be tightened either during use or prior to use to give a desired sealing effect with the rotor.

Preferably rebates are formed on the side edges, whereby the rebate of a first edge overlies the rebate of the second edge of the adjacent shell member, thereby ensuring the complete surrounding of the stator by the part cylindrical shell members.

Advantageously the internal axially extending recesses of each shell member extend generally circumferentially centrally of that shell member and the radially outwardly projecting elements on the stator each substantially completely fill the groove in the associated shell member. When the tightenable clamp or clamps are tightened, such a configuration ensures a uniform inward compression of the stator does not give rise to high spots being produced on the female helical gear formation bore of the stator.

While two or more shell members could be provided, it is preferred to have three to ensure an even clamping of the stator around the full periphery. If a very large number of shell members were used this would diminish the ability to resist torsional twisting of the stator.

Again to facilitate the clamping action, the radially outwardly projecting elements preferably are each provided with side faces which are inclined towards one another in the radially outward direction.

The invention also provides a progressive cavity pump or motor employing a stator assembly of the invention.

In order that the present invention may more readily be understood, the following description is given, merely by way of example, reference being made to the accompanying drawings in which.

Figure 1:
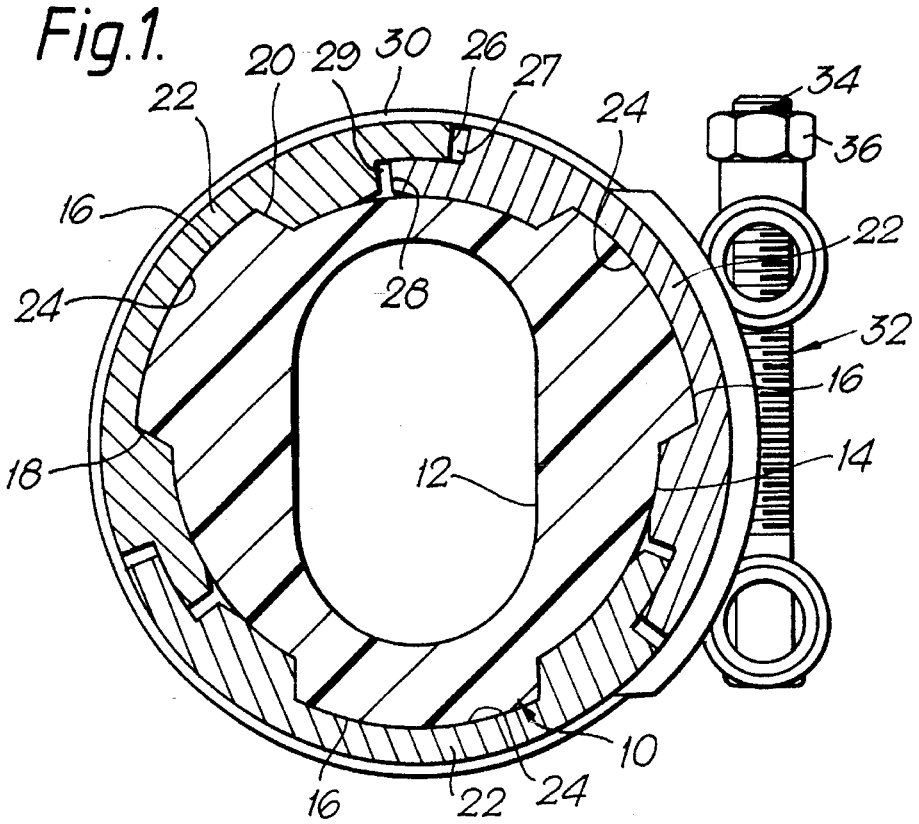
FIG. 1 is a cross-section through one embodiment of stator assembly for a progressive cavity pump or motor according to the invention.

Referring first to FIG. 1 of the drawings, the stator of the progressive cavity pump illustrated therein is indicated by the general reference numeral 10 and includes a central bore 12 having a female helical gear formation thereon of which the cross-section only can be seen in the drawing. The stator 10 is formed from a resilient material such as natural or nitrile rubber and has a generally cylindrical outer surface 14 and three axially extending radially projections 16 each equally circumferentially spaced, that is to say at 120° to one another. The outer surfaces of these projections are again part cylindrical. The side faces of the projections indicated by the reference numerals 18,20 are substantially flat and either inclined away from one another in the radially outward direction or parallel to a radial plane at the circumferential centre of the projection, as shown in the drawing. This shaping of the sides facilitates moulding of the stator. The side faces 18,20 of the projections join the outer cylindrical surface 14 at widely spaced locations. The circumferential extent of the spacing between the projections is of the same order of magnitude as the circumferential extent of the projections themselves. Thus it is contemplated that the projections could have up to 3 times the circumferential extent of the spaces therebetween. In the preferred construction shown the circumferential extent of the projection is equal to the spacing therebetween, so that the projections each subtend 60°.

Such a structure of stator can readily be moulded in conventional equipment.

Surrounding the stator itself are three shell elements 22, collectively completely surrounding the stator. Each element 22 has an axially extending recess 24, having a cross-section of identical shape to the projection 16 so that the projections closely fit into the recesses.

The elements each have side edges 26,28, in each instance formed with a rebate 27,29 so that the rebate 27 of one shell element accurately inter-fits with the rebate 29 of the opposite edge 28 of the adjacent shell element leaving a small clearance in a circumferential sense.

Surrounding the shell elements 22 is the band 30 of a screw clamp 32 of a conventional construction and which may be tightened or loosened by operation of a nut 36 threaded onto a screw 34.

It will be noted that the recesses 24 are circumferentially centrally disposed of the shell elements 22 so that when the screw of clamp 32 is tightened, there is a very even tightening of all three shell elements around the stator. Because of the tapered or parallel flat surface configuration of the side walls 18,20 of the projection 16, this operation is facilitated. With such an arrangement there is little likelihood of any bulges being produced in a the bore 12 of the stator.

Figure 2:
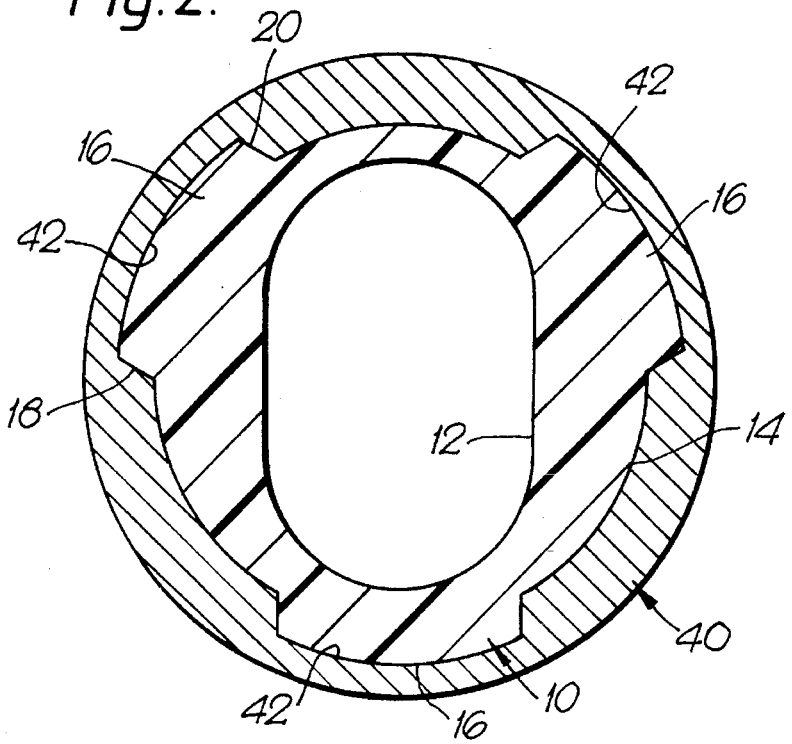
FIG. 2 is a similar view of a second embodiment.

FIG. 2 illustrates a modified structure in which the stator 10 is identical to that described with reference to FIG. 1 and like parts have been indicated by like reference numerals. The major difference is that instead of having a three part generally tubular rigid member formed by the shell elements 22, a unitary rigid tubular member 40 is provided, this having three circumferentially spaced axially extending internal recesses 42 which are substantially identical to the recesses 24 described above with reference to FIG. 1. While the rigid tubular member 40 can be formed by casting, it could be formed by broaching, but is preferably formed by extrusion. The present preferred material for the tubular member is an aluminium alloy as this extrudes easily. The same material may be used for forming the elements 22 of the FIG. 1 constructions and these may be extruded also. The extrusion is effected such that the inner surfaces of the tube are accurately cooperable with the outer surfaces of the stator, i.e., so that the stator fits very snugly therein. It will be appreciated that with such a structure there is little or no chance of torsional instability of the stator and while it does not have the advantage of FIG. 1 that a tightening of the stator can be effected, the resulting product of FIG. 2 has nearly all the advantageous characteristics of a moulded-in stator, but can be manufactured very significantly less expensively. Furthermore, when the stator itself wears, this can be discarded and a new stator inserted into the rigid tubular member 40.

Production costs can be significantly reduced because an identical "throw-away" stator can be used in combination either with the adjustable arrangement shown in FIG. 1 or with the non-adjustable version of FIG. 2.

The actual configuration of the stator and its complementary rigid tubular member 40, in FIG. 2, that is with the substantially flat side faces 18,20 and the part-cylindrical outer surfaces of the projections and the part cylindrical outer surfaces between the projections, enables the stator to be removed and replaced without too much difficulty, but prevents any relative movement between the stator, and the rigid tubular member, in use.

The production of the rigid tubular member 40 or the rigid shell members 22 by extrusion is also extremely cost effective.

Figure 3:
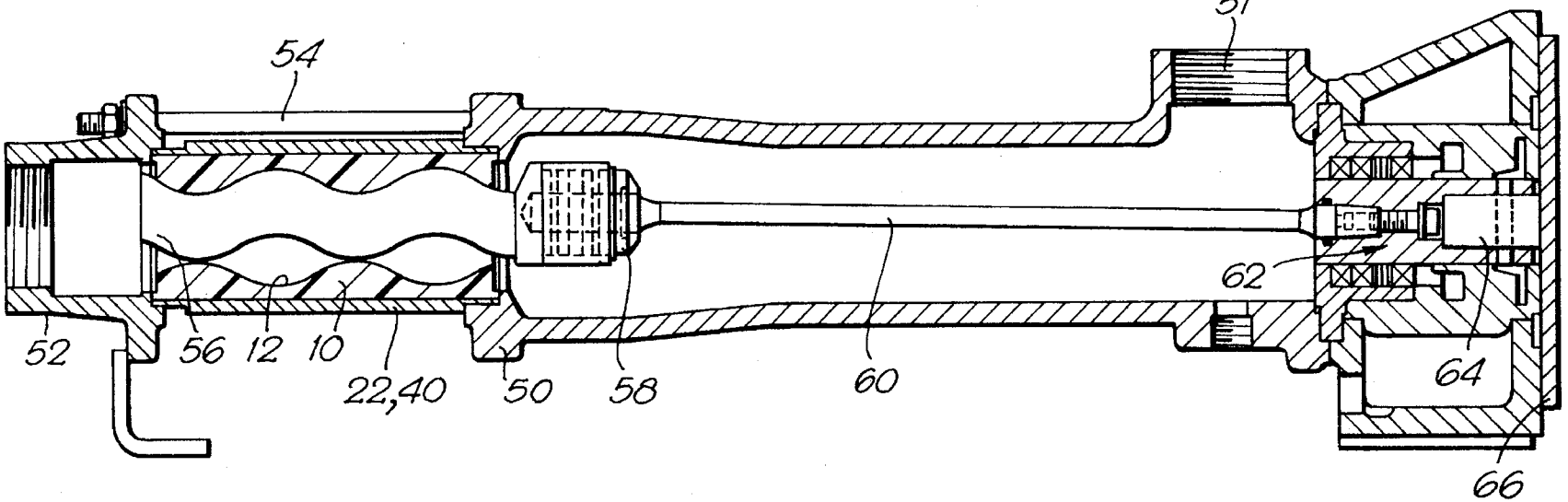
FIG. 3 is a cross-section through a progressive cavity pump employing such a stator assembly.

FIG. 3 shows the assembly of either FIG. 1 or FIG. 2 mounted in a pump. The stator 10 having the helical gear formation bore 12 is illustrated surrounded either by the tubular body member 40 or the shell member 22. The tubular member 40 or the shell member 22 are shown secured between a conventional inlet casing 50 and an outlet casing 52, these being held together by elongate bolts 54.

Rotatable within the bore 12 of the stator 10 is a rotor 56 to which is connected, by a drive connection 58, a flexible drive shaft 60 which in turn is connected by a further connection 62 to the armature shaft 64 of a motor the end plate of which is illustrated at 66.

The flexible drive shaft 60 is rotatable within the casing 50 and is surrounded by the material being pumped, this entering via an inlet passage 51.

Figure 4:
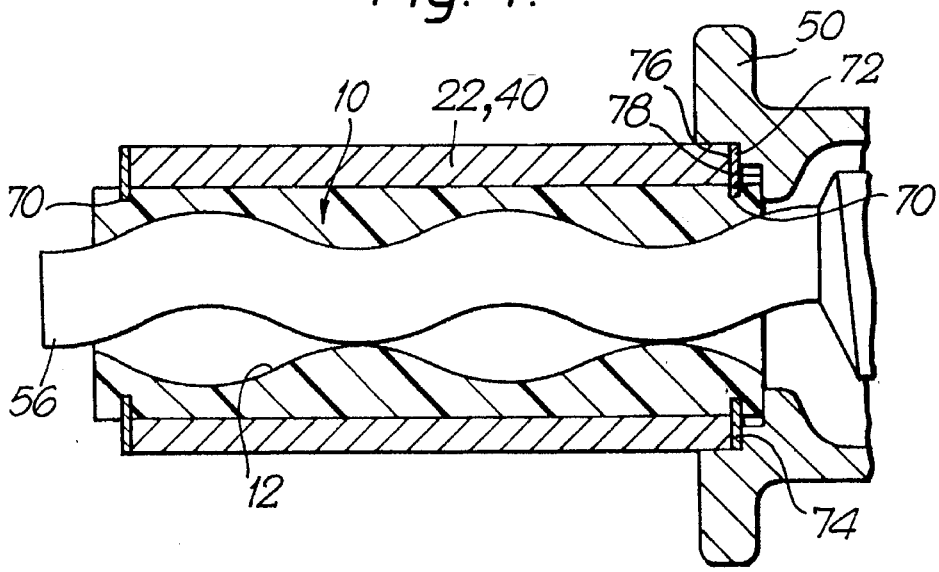
FIG. 4 is a cross-section through a modified version of the stator assembly mounted in adjacent a casing.
Figure 5:
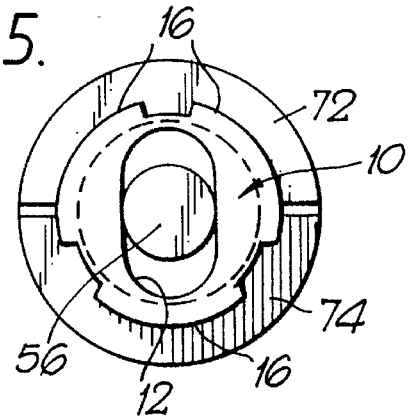
FIG. 5 is an end view of the construction of FIG. 4.

In FIGS. 4 and 5 there is illustrated a method of ensuring that excessive axial compression of the rubber stator material is not produced. In FIGS. 4 and 5, spaced about 6 mm, for example, from each axial end of the stator there is provided a circumferential groove 70 into which are fitted two semi-annular holder members 72,74. The casing 50 is provided with two shoulders 76,78 which are axially spaced by about 5 mm, for example, the larger shoulder 76 abutting the end of the face of the holder 72 and the shoulder 78 abutting the end face of the stator 12.

Thus, when the elongate bolt 54 are tightened up, the only part of the stator which will be axially compressed is that between the holder 72 and the end and this will be compressed, in this instance, by about 1 mm and this will provide an adequate seal with the casing 50.

Figure 6:
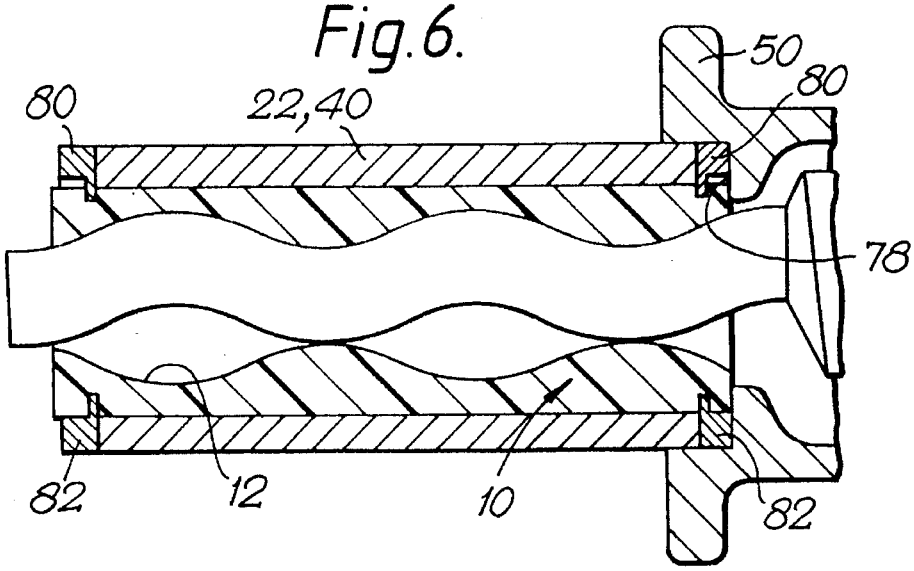
FIG. 6 is a view similar to FIG. 4 of a further modification.

FIG. 6 illustrates a slightly modified structure in which instead of there being two shoulders, there is one shoulder 78, and the two semi-annular holder members 80,82 at each end each have a thickened portion at their radially outer part so that the total axial length of each holder 80,82 will be 5 mm and the stator 12 will extend 1 mm therebeyond. This can be seen at the left side of FIG. 6. This structure simplifies the formation of the casing 50 because only one shoulder has to be produced.

We claim:

1. A stator assembly for a progressive cavity pump or motor apparatus comprising a stator having a bore with a female helical gear formation thereon of n starts, a rotor rotatable in said bore and having a cooperating male helical gear formation having n±1 starts, means to rotate or be rotated by said rotor relative to said stator, said stator assembly comprising in combination:

(a) a stator formed of a resilient material and having an axis and a substantially cylindrical outer surface;

(b) said outer surface including a plurality of axially extending, circumferentially spaced radially outwardly extending projections, having circumferential sides;

(c) a separate outer generally tubular rigid member completely surrounding said stator, but removable therefrom;

(d) a plurality of internal, axially extending, circumferentially spaced recesses having circumferential sides rigidly fixed with respect to one another, said recesses being formed on said rigid member and shaped effective to cooperate with and engage on each circumferential side of said projections to prevent relative rotation therebetween about the axis of the stator;

(e) the projections and the recesses each comprising a generally cylindrical outer face and substantially flat side faces which are inclined towards one another in the radially outward direction or substantially parallel to one another, the circumferential extent of the projections being of the same order of magnitude as the circumferential extent of the spaces therebetween.

2. An assembly as claimed in claim 1, wherein the circumferential extent of the projections is less than 3 times the circumferential extent of the spaces therebetween.

3. An assembly as claimed in claim 2, wherein the circumferential extent of the projection is equal to the circumferential extent of the spacing therebetween.

4. An assembly as claimed in claim 1, wherein said outer generally tubular rigid member completely surrounding said stator is of unitary structure having circumferentially spaced internal grooves forming said axially extending recesses and wherein said stator fits tightly therewithin.

5. An assembly as claimed in claim 1, wherein said outer generally tubular rigid member completely surrounding said stator comprises a plurality of circumferentially discrete part cylindrical shell members each having first and second axially extending side edges, and at least one tightenable clamp surrounding said shell members and enabling said shell members to be radially tightened against said stator.

6. An assembly as claimed in claim 5, and further comprising rebates formed in said side edges whereby the rebate of a first side edge overlies the rebate of the second side edge of the adjacent shell member.

7. An assembly as claimed in claim 5, wherein the internal axially extending recess of each shell member extends generally circumferentially centrally of that shell member and wherein the radially outwardly extending projections each substantially completely fill the recess in the associated shell member.

8. An assembly as claimed in claim to 5, wherein there are three shell members.

9. An assembly as claimed in claim 1, wherein the outer generally tubular rigid member is formed as an extrusion or extrusions of an aluminium alloy.

10. A progressive cavity pump or motor apparatus comprising a stator assembly having a bore with a female helical gear formation thereon of n starts, a rotor rotatable in said bore and having a cooperating male helical gear formation having n±1 starts, means to rotate or be rotated by said rotor relative to said stator, said stator being part of a stator assembly comprising in combination:

(a) a stator formed of a resilient material and having an axis and a substantially cylindrical outer surface;

(b) said outer surface including a plurality of axially extending, circumferentially spaced radially outwardly extending projections, having circumferential sides;

(c) a separate outer generally tubular rigid member completely surrounding said stator, but removable therefrom;

(d) a plurality of internal, axially extending, circumferentially spaced recesses having circumferential sides rigidly fixed with respect to one another, said recesses being formed on said rigid member and shaped effective to cooperate with and engage on each circumferential side of said projections to prevent relative rotation therebetween about the axis of the stator;

(e) the projections and the recesses each comprising a generally cylindrical outer face and substantially flat side faces which are inclined towards one another in the radially outward direction or substantially parallel to one another, the circumferential extent of the projections being of the same order of magnitude as the circumferential extent of the spaces therebetween.

* * * * *